US009255457B2

(12) United States Patent
Scarsdale et al.

(10) Patent No.: US 9,255,457 B2
(45) Date of Patent: Feb. 9, 2016

(54) DEEP DEPLOYMENT SYSTEM FOR ELECTRIC SUBMERSIBLE PUMPS

(71) Applicant: Schlumberger Technology Corporation, Sugar Land, TX (US)

(72) Inventors: Kevin T. Scarsdale, Pearland, TX (US); Brian Scott, Aberdeen (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 158 days.

(21) Appl. No.: 13/864,322

(22) Filed: Apr. 17, 2013

(65) Prior Publication Data

US 2013/0277042 A1 Oct. 24, 2013

Related U.S. Application Data

(60) Provisional application No. 61/635,261, filed on Apr. 18, 2012.

(51) Int. Cl.

| | |
|---|---|
| ***E21B 43/12*** | (2006.01) |
| ***E21B 23/00*** | (2006.01) |
| ***E21B 23/01*** | (2006.01) |
| ***E21B 47/00*** | (2012.01) |
| ***E21B 17/20*** | (2006.01) |

(52) U.S. Cl.

CPC ..... *E21B 23/00* (2013.01); *E21B 17/206* (2013.01); *E21B 23/01* (2013.01); *E21B 43/128* (2013.01); *E21B 47/0006* (2013.01)

(58) Field of Classification Search

CPC ..... E21B 43/12; E21B 43/128

See application file for complete search history.

(56) References Cited

U.S. PATENT DOCUMENTS

| | | | | |
|---|---|---|---|---|
| 2005/0045343 | A1 | 3/2005 | Bixenman et al. | |
| 2009/0308618 | A1 * | 12/2009 | Collie | 166/385 |
| 2010/0288493 | A1 | 11/2010 | Fielder et al. | |
| 2010/0288501 | A1 | 11/2010 | Fielder et al. | |
| 2011/0240312 | A1 | 10/2011 | Varkey et al. | |
| 2011/0297397 | A1 | 12/2011 | Morrison et al. | |
| 2013/0272906 | A1 * | 10/2013 | Head | 417/410.1 |

FOREIGN PATENT DOCUMENTS

| | | |
|---|---|---|
| WO | 2011/106513 | 9/2011 |
| WO | 2011/146353 | 11/2011 |
| WO | 2011/146949 | 11/2011 |
| WO | 2012/045771 | 4/2012 |
| WO | 2012/049508 | 4/2012 |

OTHER PUBLICATIONS

Search Report for the equivalent GB patent application No. 1306977.8 issued on Sep. 25, 2013.

* cited by examiner

*Primary Examiner* — William P Neuder

(74) *Attorney, Agent, or Firm* — Michael Stonebrook

(57) ABSTRACT

A system for deep deployment of electric submersible pumps is described. In an implementation, an electric submersible pump (ESP) power cable has a strength member that enables the ESP power cable to support itself when lowered deep into a well inside a coiled tubing. The self-supporting ESP power cable frees the coiled tubing from having to carry the weight of the ESP power cable, thereby permitting longer runs of coiled tubing to be suspended into the well. The ESP power cable and the coiled tubing can be anchored independently to a wellhead, and a computing device can monitor the weight loads on the ESP power cable and on the coiled tubing.

22 Claims, 5 Drawing Sheets

DEEP DEPLOYMENT SYSTEM FOR ELECTRIC SUBMERSIBLE PUMPS

RELATED APPLICATIONS

This patent application claims the benefit of priority to U.S. Provisional Patent Application No. 61/635,261 filed Apr. 18, 2012 and incorporated herein by reference in its entirety.

BACKGROUND

In oil wells that use electric submersible pumps (ESPs), coiled tubing is sometimes used in place of coupled tubes to deploy the ESP. Coiled tubing is composed of a continuous length of steel or composite tubing that is flexible enough to be coiled on a large reel for portability to the site. The coiled tubing is unwound from the reel and inserted into the well or injected into an existing production string. Often the ESP power cable is contained within the coiled tubing, to be deployed or intervened into a well or production string. For deeper wells, the weight of the ESP power cable can add up to tons. The conventional ESP power cable does not have high tensile strength, and thus has operational constraints in the mode of deployment. For example, the length of cable that can be pulled into a length of coiled tubing is limited to the point at which increasing the pulling tension would damage the cable. Also, the inability of the power cable to support any significant amount of its own weight as it is lowered more deeply into a well or production string requires the presence of additional mechanisms and processes for supporting the power cable along its length when deployed into a well, inside the coiled tubing.

SUMMARY

A deep deployment system for electric submersible pumps (ESPs) is provided. An example system includes a coiled tubing for placing an electric submersible pump (ESP) in a well, a cable inside a hollow interior of the coiled tubing for connecting to the ESP, and a strength member running in the cable to enable the cable to be suspended from an end of the cable without support from the coiled tubing. An example power cable for an electric submersible pump (ESP) includes conductors for providing electricity to the ESP, and a strength member for supporting the weight of the power cable when the power cable is suspended from a wellhead. In an implementation, an example system includes a wellhead connector for securely fastening to a wellhead, a first anchor connected to the wellhead connector to support a length of coiled tubing suspended in a well, a second anchor connected to the wellhead connector to support a length of power cable independently suspended in the well and suspended inside the coiled tubing, and a strength member in the power cable connected to the second anchor to enable the power cable to support its own weight.

DETAILED DESCRIPTION

Figure 1:
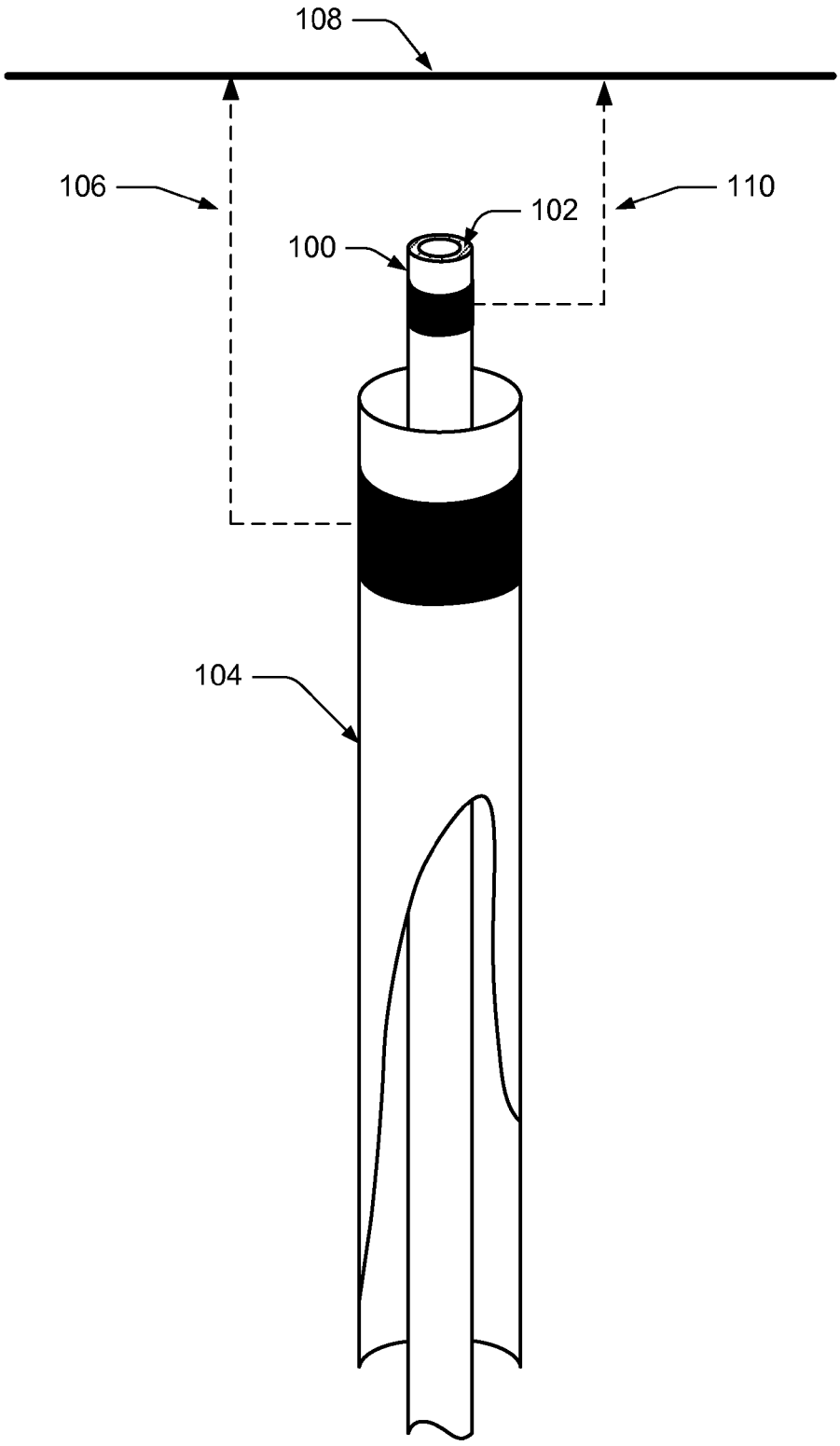
FIG. 1 is a diagram of an example coiled tubing for an ESP deployment independently suspended from a wellhead support and an example ESP power cable inside the coiled tubing independently suspended from the same wellhead support.

This disclosure describes a deep deployment system for electric submersible pumps. In an implementation, as shown in FIG. 1, a deployed ESP power cable 100 is constructed to include a strength member 102 in order to significantly augment the tensile strength of the ESP power cable 100 and to render the ESP power cable 100 self-supporting. The strengthened ESP power cable 100 is installed inside coiled tubing 104 for deployment of an electric submersible pump (ESP) in a well, but does not rely on the coiled tubing 104 for support along the length of the ESP power cable 100. Rather, the coiled tubing 104 is attached via a first anchor 106 to a supporting wellhead 108, and the ESP power cable 100 is attached independently via a second anchor 110 to the supporting wellhead 108.

Although an ESP power cable 100 is used as an example herein, the description may also be applied to other elongated members deployed within coiled tubing, such as a wire, a line, an instrument cable, a control cable, a service cable, a hydraulic line, a tube, and so forth, to be deployed or intervened into a well or production string. In the example, the tensile strength of the strengthened ESP power cable 100 allows for significantly longer lengths of ESP power cable 100 to be installed inside the coiled tubing 104 compared with conventional power cable, and thus can be used to install ESP equipment to greater depths in wells. Additional mechanisms and processes to support the ESP power cable 100 along its length, such as deriving support from the coiled tubing 104, are not required. This also allows longer lengths of the coiled tubing 104 to be deployed to greater depths, since the coiled tubing 104 only has to bear its own weight and the weight of attached equipment, and does not have to support the ESP power cable 100. The addition of the strengthened ESP power cable 100 inside the coiled tubing 104 can be used to further extend the maximum deployment depth by carrying the majority of the bottom hole assembly (BHA) weight. In such an implementation, the coiled tubing 104 again only needs to support its own weight, enabling significantly deeper deployments.

Having the strengthened ESP power cable 100 independently anchored 110 in the wellhead 108 also eliminates the need to devise complex manufacturing processes to helically buckle the ESP power cable 100 inside the coiled tubing 104. These two features significantly reduce the complexity of coiled tubing systems, and increase the maximum depth to which a coiled tubing system can be deployed.

Figure 2:
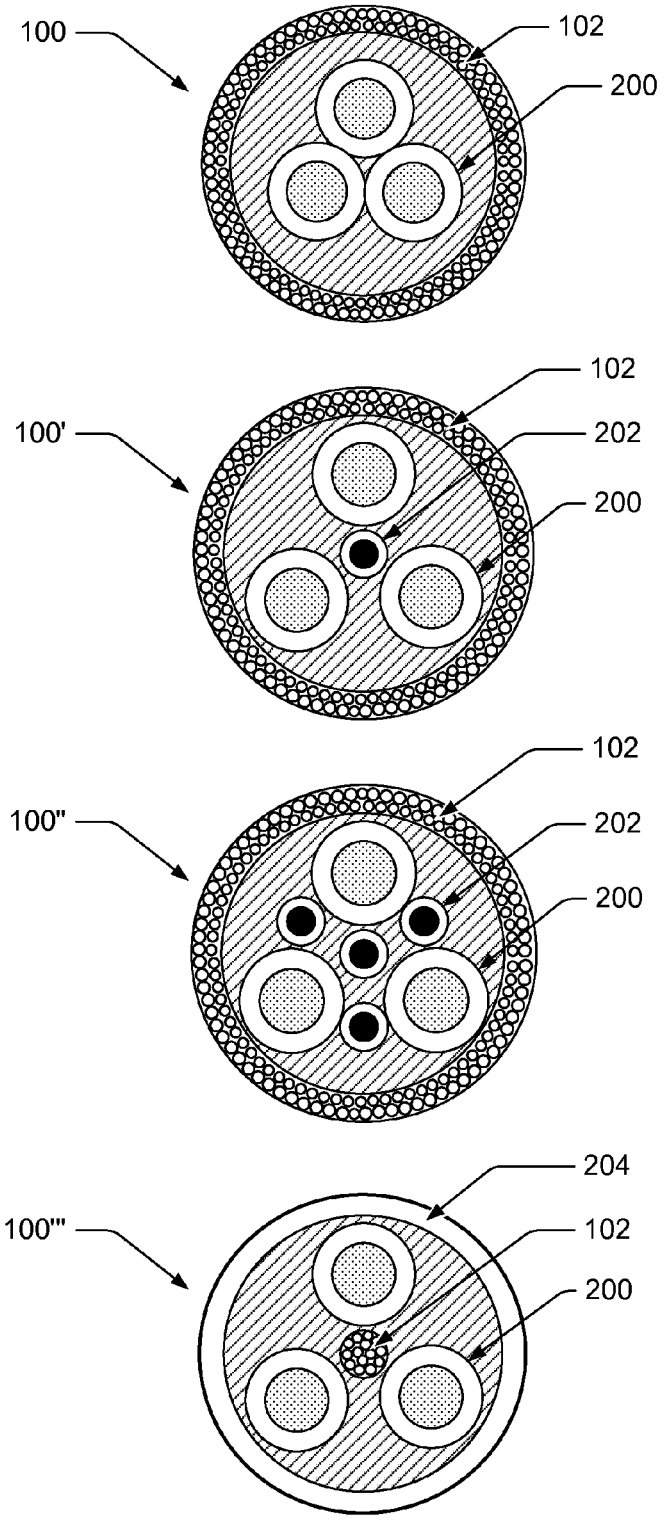
FIG. 2 is a diagram of various implementations of an example ESP power cable with strength member.

FIG. 2 shows example embodiments of an ESP power cable 100 with strength member 102. For example, the ESP power cable 100 may include the strength member 102 as an outside layer, cladding, sheath, or armor, and in addition to the interior body material of the cable, may additionally include only electrical conductors 200 (i.e., insulated wires) to provide power, such as three-phase power, to the ESP.

In another implementation, an ESP power cable 100' may also include a single control line 202 for injection, chemical injection, monitoring, and so forth. Or, an ESP power cable 100" may include multiple control lines 202. The strength member 102 does not have to be an outer sheath, cladding, or armor. For example, an ESP power cable 100''' may have the strength member 102 in the interior of the cable 100''', or at the center of the cable 100'''. Then, the outer layer 204 of the cable 100''' can be an elastomeric covering, or a metal or nonmetal (i.e., non-weight-supporting) outer armor or sheath.

In an implementation, the ESP power cable 100 has attached control lines in a flat pack that is banded to an exterior strength member 102.

Figure 3:
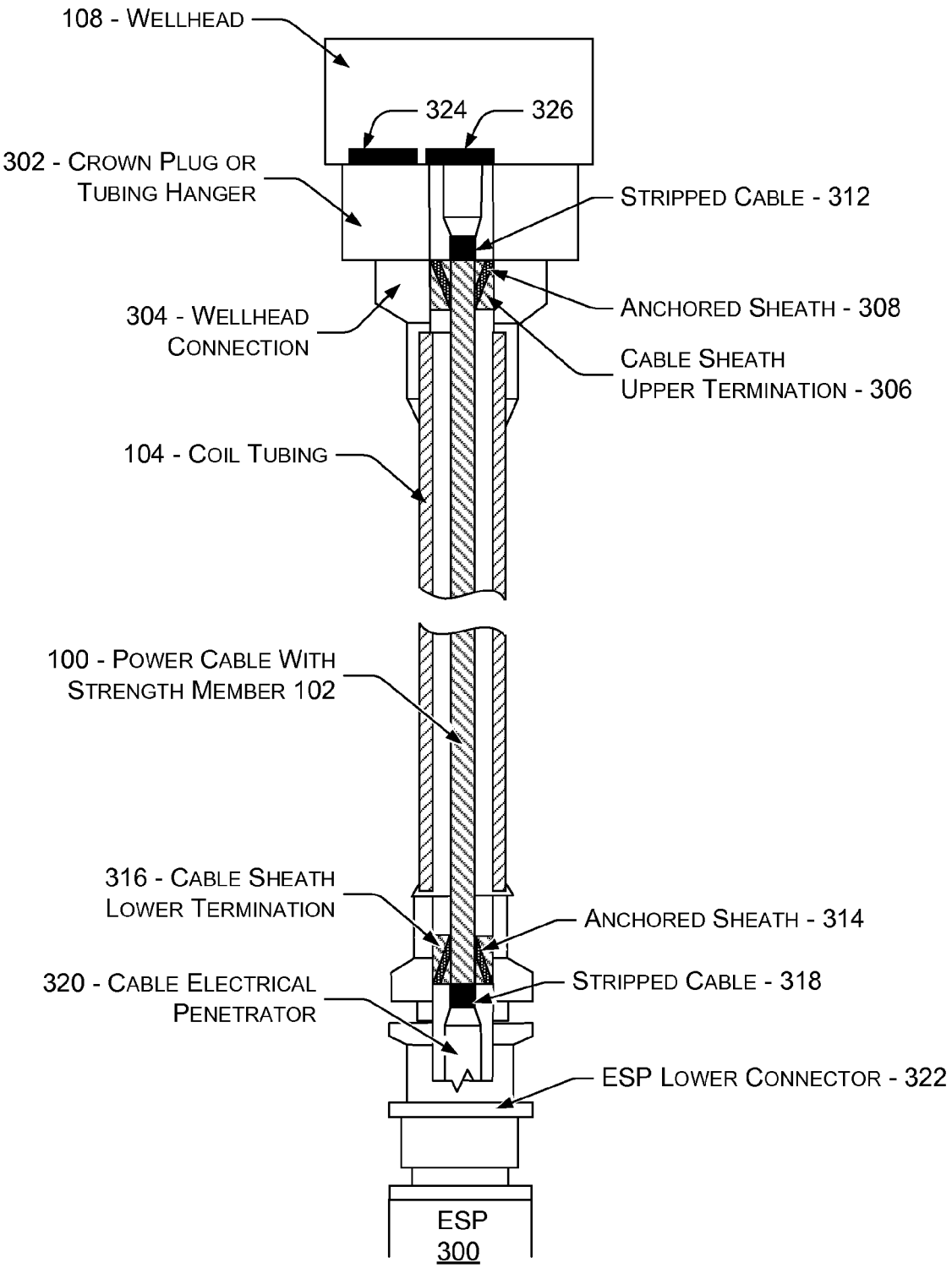
FIG. 3 is a diagram of an example deployment of a coiled tubing for suspending an electric submersible pump (ESP) in a well and an independently suspended ESP power cable inside the coiled tubing.

FIG. 3 shows an example system for deep deployment of an ESP 300. To the wellhead 108 is attached a crown plug or tubing hanger 302, and in turn, a wellhead connection 304. The power cable 100 with strength member 102 is suspended independently, apart from the coiled tubing 104, and is separately suspended from the wellhead connection 304 or other hanger support. In an implementation, the outer sheath of the ESP power cable 100 is the strength member 102. The strength member 102 (outer sheath) is anchored at a cable sheath upper termination 306 connected ultimately to the physical support of the wellhead 108, resulting in an anchored sheath 308. The anchored sheath 308 physically supports the length of the ESP power cable 100 that is downhole. The interior of the ESP power cable 100 can be referred to as a stripped cable 312 and includes the ends of the electrical conductors (wires) and any other control lines, etc., present in the ESP power cable 100. The surface end of the stripped cable 312 proceeds out of the wellhead 108 to its destination elsewhere on the surface, e.g., to a surface facility.

At the downhole end of the ESP power cable 100 that includes the strength member 102, there may also be a second anchored sheath 314 at a cable sheath lower termination 316. However, the cable sheath lower termination 316 does not have to bear the weight of the ESP power cable 100 in the well. The stripped cable 318 at the downhole end proceeds through a cable electrical penetrator and through an ESP lower connector 322 to its termination in the ESP 300.

In an implementation, a first weight detector 324 measures or monitors the weight or mass (load) of the coiled tubing 104 anchored at the wellhead connection 304. A second weight detector 326 separately monitors the weight or mass (load) of the ESP power cable 100. Besides monitoring for absolute weight of the coiled tubing 104, the first weight detector 324 may also monitor for an extra "unauthorized" weight of the coiled tubing 104 above a theoretically calculated weight, which would indicate that the coiled tubing 104 is supporting some of the load of the ESP power cable 100 (e.g., because of a snag, bend, buckling, coiling, protrusion, foreign object, or other occurrence in the coiled tubing 104, by which the ESP power cable 100 is deriving support from the coiled tubing 104). On the other hand, besides monitoring for absolute weight of the ESP power cable 100, the second weight detector 326 may also monitor for a deficiency in the weight of the ESP power cable 100 below a theoretically calculated weight, which would indicate that the ESP power cable 100 is deriving support from the coiled tubing 104, when it is not supposed to be. Thus, the first weight detector 324 and the second weight detector 326 can ensure that the coiled tubing 104 is carrying only its own weight and the weight of authorized attachments and ESP equipment.

Figure 4:
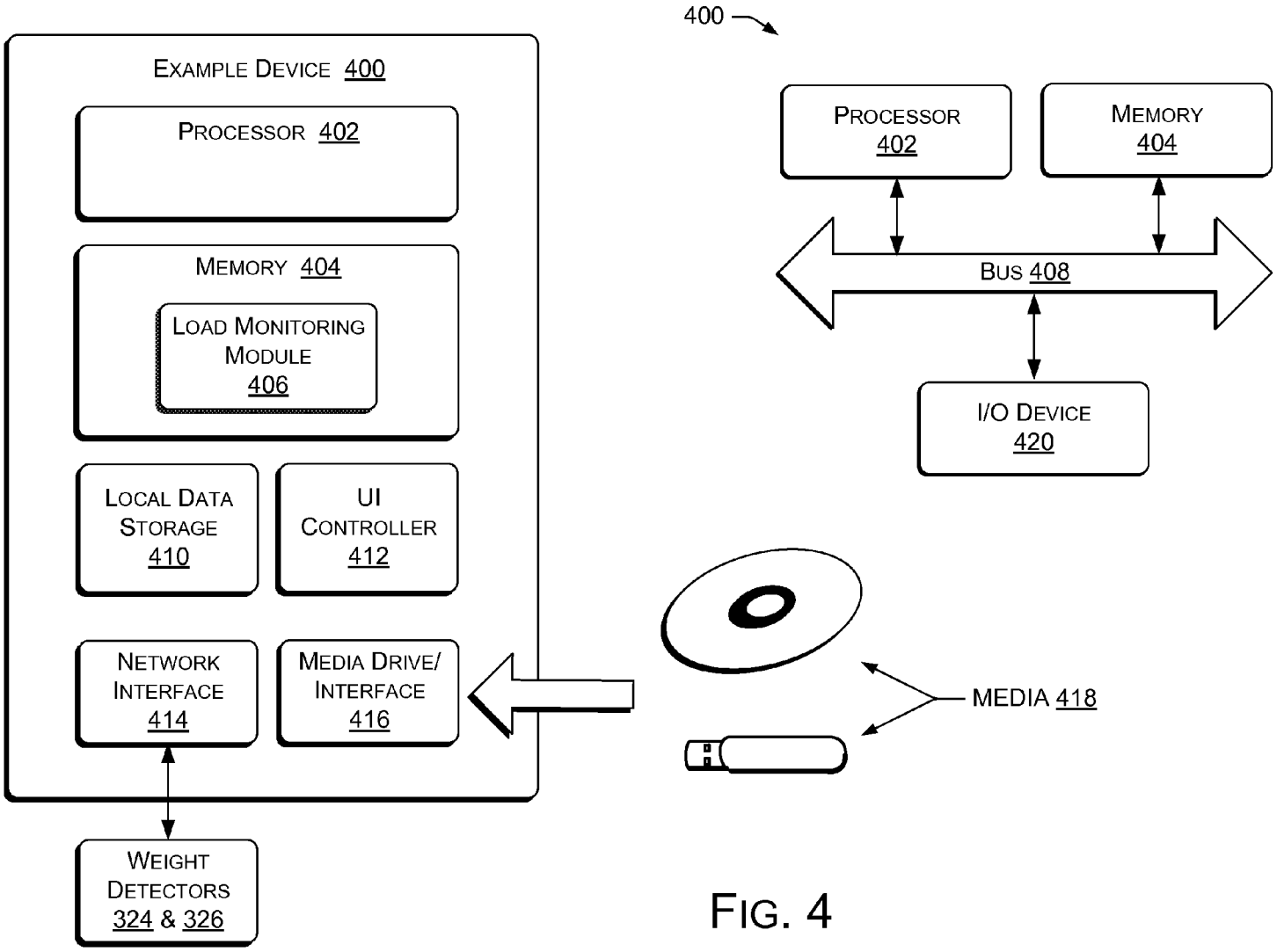
FIG. 4 is a flow diagram of an example method of improving depth of deployment of an ESP.

FIG. 4 shows an example device 400 with processor 402 and memory 404 for hosting an example load monitoring module 406 for tracking weights of the suspended coiled tubing 104 and the ESP power cable 100 (including strength member 102), in a well. The shown example device 400 is only one example of a computing device or programmable device, and is not intended to suggest any limitation as to scope of use or functionality of the example device 400 and/or its possible architectures. Neither should the example device 400 be interpreted as having any dependency or requirement relating to one or to a combination of components illustrated in the example device 400.

Example device 400 includes one or more processors or processing units 402, one or more memory components 404, the load monitoring module 406, a bus 408 that allows the various components and devices to communicate with each other, and includes local data storage 410, among other components.

Memory 404 generally represents one or more volatile data storage media. Memory component 404 can include volatile media (such as random access memory (RAM)) and/or non-volatile media (such as read only memory (ROM), flash memory, and so forth).

Bus 408 represents one or more of any of several types of bus structures, including a memory bus or memory controller, a peripheral bus, an accelerated graphics port, and a processor or local bus using any of a variety of bus architectures. Bus 408 can include wired and/or wireless buses.

Local data storage 410 can include fixed media (e.g., RAM, ROM, a fixed hard drive, etc.) as well as removable media (e.g., a flash memory drive, a removable hard drive, optical disks, magnetic disks, and so forth).

A user interface device may also communicate via a user interface (UI) controller 412, which may connect with the UI device either directly or through the bus 408.

A network interface 414 may communicate outside of the example device 400 via a connected network, and in some implementations may communicate with hardware, such as the weight detectors 324 & 326. In other implementations, the weight detectors 324 & 326 communicate with the example device 400 as input/output devices 420 via the bus 408 and via a USB port, for example.

A media drive/interface 416 accepts removable tangible media 418, such as flash drives, optical disks, removable hard drives, software products, etc. Logic, computing instructions, or a software program comprising elements of the load monitoring module 406 may reside on removable media 418 readable by the media drive/interface 416.

One or more input/output devices 420 can allow a user to enter commands and information to example device 400, and also allow information to be presented to the user and/or other components or devices. Examples of input devices 420 include, in some implementations, the weight detectors 324 and 326, as well as keyboard, a cursor control device (e.g., a mouse), a microphone, a scanner, and so forth. Examples of output devices include a display device (e.g., a monitor or projector), speakers, a printer, a network card, and so forth.

Various processes of the load monitoring module 406 may be described herein in the general context of software or program modules, or the techniques and modules may be implemented in pure computing hardware. Software generally includes routines, programs, objects, components, data structures, and so forth that perform particular tasks or implement particular abstract data types. An implementation of these modules and techniques may be stored on or transmitted across some form of tangible computer readable media. Computer readable media can be any available data storage medium or media that is tangible and can be accessed by a computing device. Computer readable media may thus comprise computer storage media.

"Computer storage media" designates tangible media, and includes volatile and non-volatile, removable and non-removable tangible media implemented for storage of information such as computer readable instructions, data structures, program modules, or other data. Computer storage media include, but are not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other tangible medium which can be used to store the desired information, and which can be accessed by a computer.

EXAMPLE METHOD

Figure 5:
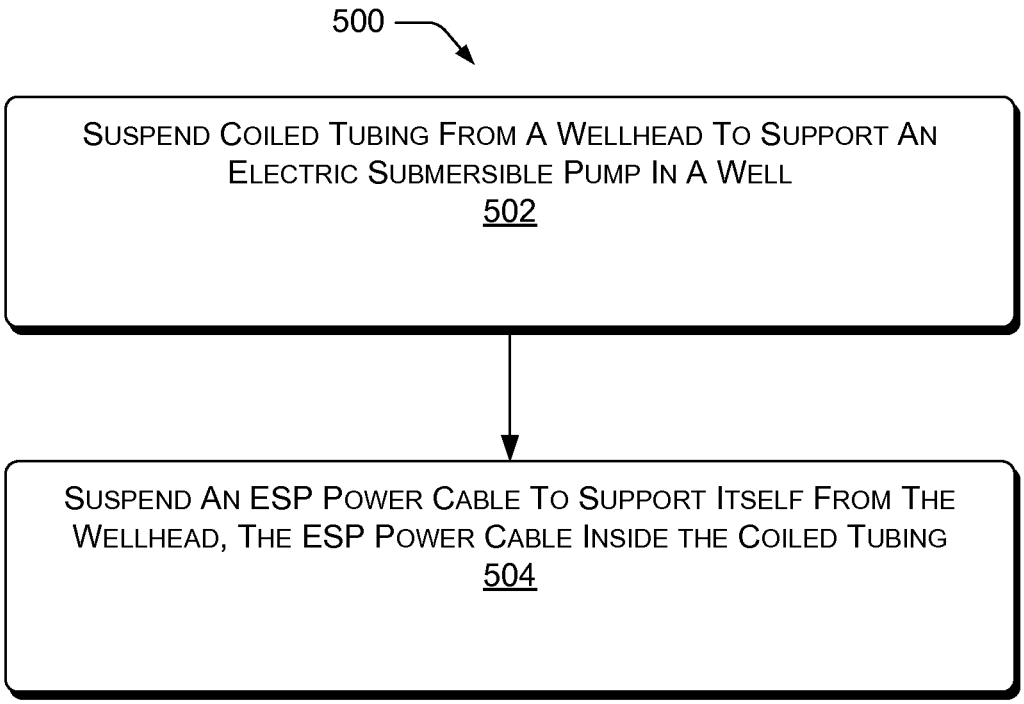
FIG. 5 is a block diagram of an example computing device for monitoring a weight load of the coiled tubing and a weight load of the ESP power cable.

FIG. 5 is an example method 500 of improving depth of deployment of an electric submersible pump (ESP). In the flow diagram, operations are represented by individual blocks.

At block 502, coiled tubing is suspended from a wellhead to support an electric submersible pump in a well.

At block 504, an ESP power cable including strength member is suspended to support itself from the wellhead, wherein the ESP power cable is deployed inside the coiled tubing.

CONCLUSION

Although only a few example embodiments have been described in detail above, those skilled in the art will readily appreciate that many modifications are possible in the example embodiments without materially departing from the subject matter. Accordingly, all such modifications are intended to be included within the scope of this disclosure as defined in the following claims. In the claims, means-plus-function clauses are intended to cover the structures described herein as performing the recited function and not only structural equivalents, but also equivalent structures. It is the express intention of the applicant not to invoke 35 U.S.C. §112, paragraph 6 for any limitations of any of the claims herein, except for those in which the claim expressly uses the words 'means for' together with an associated function.

The invention claimed is:

1. A system, comprising:

a coiled tubing for placing an electric submersible pump (ESP) in a well;

an ESP power cable inside a hollow interior of the coiled tubing for connecting to the ESP;

a strength member running in the cable to enable the cable to be suspended by anchoring an end of the cable without support from the coiled tubing;

a first anchor to connect an end of the coiled tubing to a wellhead and to support the entire weight of the coiled tubing and the ESP; and a second anchor to connect an end of the ESP power cable to the wellhead and support the entire weight of the ESP power cable without support from the coiled tubing; and a first weight detector operatively connected to the first anchor, to monitor a weight or a mass of the deployed coiled tubing to ensure that the coiled tubing is supporting only the weight of the coiled tubing and the weight of the ESP and not supporting the weight of the ESP power cable.

2. The system of claim 1, further comprising a second weight detector operatively connected to the second anchor, to monitor a weight or a mass of the deployed ESP power cable to ensure that the ESP power cable is supporting the weight of the ESP power cable and that the ESP power cable is not being substantially supported by the coiled tubing.

3. The system of claim 2, further comprising a computing device in communication with the first weight detector and the second weight detector to monitor a weight load of the coiled tubing and to monitor a weight load of the ESP power cable.

4. The system of claim 1, wherein the cable comprises one of a wire, an instrument cable, a service cable, a line, or a tube.

5. The system of claim 1, wherein the cable comprises an ESP power cable, and the strength member has a high tensile strength to enable the ESP power cable to bear the weight of the ESP power cable in a deep deployment of the ESP power cable.

6. The system of claim 1, wherein the cable comprises an ESP power cable and the strength member runs inside an interior of the ESP power cable.

7. The system of claim 1, wherein the cable comprises an ESP power cable and the strength member runs as an outside layer, a cladding, a sheath, or an armor of the ESP power cable.

8. The system of claim 7, wherein the strength member runs as an outside layer of the ESP power cable, and further comprising:

electrical conductors running in the interior of the ESP power cable to provide three-phase power to the ESP; and one or more control lines for the ESP in the interior of the ESP power cable.

9. The system of claim 1, further comprising a flat pack of control lines banded to an exterior of the cable.

10. The system of claim 1, wherein the cable comprises an ESP power cable and the strength member enables the ESP power cable to be suspended inside the coiled tubing without helically buckling the ESP power cable.

11. A system, comprising:

a wellhead connector for securely fastening to a wellhead;

a first anchor connected to the wellhead connector to support a length of coiled tubing suspended in a well;

a second anchor connected to the wellhead connector to support a length of power cable independently suspended in the well and suspended inside the coiled tubing;

a strength member in the power cable connected to the second anchor to enable the power cable to support the weight of the power cable;

a first weight detector operatively connected to the first anchor, to monitor a weight or a mass of the coiled tubing; and a second weight detector operatively connected to the second anchor, to monitor a weight or a mass of the power cable.

12. The system of claim 11, further comprising a load monitoring module and a computing device in communication with the first weight detector and the second weight detector to monitor a weight load of the coiled tubing and to monitor a weight load of the power cable, and to ensure that the power cable is supporting the weight of the power cable and that the power cable is not being substantially supported by the coiled tubing.

13. A system, comprising:

a coiled tubing for placing an electric submersible pump (ESP) in a well;

a cable inside a hollow interior of the coiled tubing for connecting to the ESP;

a strength member running in the cable to enable the cable to be suspended by anchoring an end of the cable without support from the coiled tubing; and a flat pack of control lines banded to an exterior of the cable.

14. The system of claim 13, wherein the cable comprises an ESP power cable, and further comprising:

a first anchor to connect an end of the coiled tubing to a wellhead and to support the entire weight of the coiled tubing and the ESP; and a second anchor to connect an end of the ESP power cable to the wellhead and support the entire weight of the ESP power cable without support from the coiled tubing.

15. The system of claim 14, further comprising:

a first weight detector operatively connected to the first anchor, to monitor a weight or a mass of the deployed coiled tubing to ensure that the coiled tubing is supporting only the weight of the coiled tubing and the weight of the ESP and not supporting the weight of the ESP power cable; and a second weight detector operatively connected to the second anchor, to monitor a weight or a mass of the deployed ESP power cable to ensure that the ESP power cable is supporting the weight of the ESP power cable and that the ESP power cable is not being substantially supported by the coiled tubing.

16. The system of claim 15, further comprising a computing device in communication with the first weight detector and the second weight detector to monitor a weight load of the coiled tubing and to monitor a weight load of the ESP power cable.

17. The system of claim 13, wherein the cable comprises one of a wire, an instrument cable, a service cable, a line, or a tube.

18. The system of claim 13, wherein the cable comprises an ESP power cable, and the strength member has a high tensile strength to enable the ESP power cable to bear the weight of the ESP power cable in a deep deployment of the ESP power cable.

19. The system of claim 13, wherein the cable comprises an ESP power cable and the strength member runs inside an interior of the ESP power cable.

20. The system of claim 13, wherein the cable comprises an ESP power cable and the strength member runs as an outside layer, a cladding, a sheath, or an armor of the ESP power cable.

21. The system of claim 20, wherein the strength member runs as an outside layer of the ESP power cable, and further comprising:

electrical conductors running in the interior of the ESP power cable to provide three-phase power to the ESP; and one or more control lines for the ESP in the interior of the ESP power cable.

22. The system of claim 13, wherein the cable comprises an ESP power cable and the strength member enables the ESP power cable to be suspended inside the coiled tubing without helically buckling the ESP power cable.

* * * * *